US005802734A

United States Patent [19]

Manzolli

[11] Patent Number: 5,802,734

[45] Date of Patent: Sep. 8, 1998

[54] METHOD FOR FACILITY FOR DEHYDRATING PLANTS, PARTICULARLY FOR DEHYDRATING FORAGE

[75] Inventor: Giuseppe Imo Manzolli, Rosolina, Italy

[73] Assignee: Marlegreen Holding S.A., Luxembourg, Luxembourg

[21] Appl. No.: 935,775

[22] Filed: Sep. 23, 1997

Related U.S. Application Data

[62] Division of Ser. No. 677,655, Jul. 8, 1996, Pat. No. 5,692, 317.

[30] Foreign Application Priority Data

Jul. 14, 1995 [IT] Italy ..... MI95A1538

[51] Int. Cl.[6] ..... F26B 19/00

[52] U.S. Cl. ..... 34/63; 34/137; 34/203

[58] Field of Search ..... 34/386, 387, 422, 34/423, 500, 518, 60, 63, 108, 109, 136, 137, 138, 139, 627, 636, 171, 203, 205; 426/456, 637; 131/299, 300, 303, 313, 312, 318

[56] References Cited

U.S. PATENT DOCUMENTS

| | | | |
|---|---|---|---|
| 173,078 | 2/1876 | Stacy | 34/447 X |
| 1,235,722 | 8/1917 | Peper | 131/318 |
| 1,368,134 | 2/1921 | Gilchrist et al. | 34/385 X |
| 2,151,527 | 3/1939 | Podmore | 34/387 X |
| 2,446,952 | 8/1948 | Randolph | 34/387 X |
| 3,360,868 | 1/1968 | Arnold | 34/63 |
| 3,937,227 | 2/1976 | Azumano | 131/302 |
| 4,376,343 | 3/1983 | White et al. | 34/109 |
| 4,392,501 | 7/1983 | Newton et al. | 131/300 |
| 4,559,235 | 12/1985 | Miller | 426/636 |
| 4,813,154 | 3/1989 | Ronning | 34/137 X |
| 5,105,563 | 4/1992 | Fingerson et al. | 34/203 |

*Primary Examiner*—Henry A. Bennett
*Assistant Examiner*—Steve Gravini
*Attorney, Agent, or Firm*—Daniel O'Byrne

[57] ABSTRACT

A method and a facility for dehydrating plants, particularly for dehydrating forage. The method consists in introducing the forage to be dehydrated in a drier with a retention time and a temperature that are suitable to achieve the at least partial drying of the leaves of the forage. The forage, when it leaves the drier, is subjected to an operation for separating the leaves from the stalks, and the leaves and stalks thus separated are then subjected, separately from each other, to additional treatments that include at least one additional drying for at least one of the two components constituted by the leaves and the stalks.

18 Claims, 2 Drawing Sheets

METHOD FOR FACILITY FOR DEHYDRATING PLANTS, PARTICULARLY FOR DEHYDRATING FORAGE

This application is a division of application Ser. No. 08/677,655, filed on Jul. 8, 1996 U.S. Pat. No. 5,692,317.

BACKGROUND OF THE INVENTION

The present invention relates to a method and an apparatus for dehydrating plants, particularly for dehydrating forage such as alfalfa or the like.

Methods and facilities for dehydrating various kinds of forage are known. In particular, as regards the dehydration of alfalfa, two types of process are currently used; more particularly, a process that consists in performing drying at low temperature and a process that consists in performing drying at high temperature.

In order to dry alfalfa at low temperature, one uses driers in which the alfalfa is loaded automatically by means of a rotating paddle wheel and fed into the drier, where it falls, with a low and uniform thickness, onto the conveyor belt or ribbon, which is made of special metal mesh and is provided with conveyor combs. The conveyor belt or ribbon moves slowly toward the ports for introducing hot air that arrives from an oven or boiler, and then spills the partially dried forage onto a second lower conveyor that returns the alfalfa, in the return stroke, toward the same head of the device, where it arrives fully dried. The speed of the conveyors can be adjusted automatically by means of thermoelectric relays that also control the temperature of the hot air. The duration of the drying, with a temperature that can vary substantially between 130° C. and 200° C. inside the drier, is between 15 and 25 minutes, depending on the water content of the alfalfa and on the type of facility.

High-temperature dehydration is performed with driers that are formed by a long rotating drum, in which movement of the forage is ensured by fork-like or comb-like elements. The air heated in the boiler is aspirated at high speed by a fan into the drum, where uniform and very fast dehydration of the leaves occurs, lasting approximately 1–2seconds; the leaves are immediately evacuated by the air stream, whereas drying of the stalks of the alfalfa requires approximately three minutes.

The forage that leaves the drier passes through a cooling cyclone, where its temperature is lowered to the ambient value, and is then ground to obtain a floury product, which is optionally then compressed into flat blocks or cubes.

Dehydration of alfalfa has the purpose of maintaining as much as possible the content of protein, carotenes, vitamins, calcium, and phosphor that are present in the fresh product and would largely be lost with natural drying.

Flours made of alfalfa that has been dehydrated at high temperature are widely used in the preparation of balanced mixtures of fodder, not so much as net energy providers but as excellent integrators of the rations in protein, carotene, calcium, vitamins of the B complex, and mineral microelements.

The methods that are currently used to dehydrate forage, particularly to dehydrate alfalfa, despite being able to preserve a fair percentage of the nutrients, protein, carotenes, and vitamins that are present in green forage, have the drawback of producing a product in which said substances are considerably diluted within the mass constituted by the fibers of the stalks, which are considerably poorer in these substances with respect to the leaves.

Because of this fact, in the preparation of balanced fodder mixtures it is very often necessary to add, together with the dehydrated alfalfa, appropriate additives that considerably affect the production costs of said mixtures.

Furthermore, in conventional dehydration systems, the two products constituted by the leaves and by the stalks normally coexist throughout the dehydration process, i.e., the stalks and the leaves, despite remaining, in some high-temperature facilities, in contact with the hot air for different times, inevitably, at the end of the process, always tend to arrive with considerably different humidity values, also because conventional facilities, despite having some variable parameters, such as for example the amount of heat in the boiler, the amount and speed of the process air, the rotation rate of the rotating drum, etcetera, are difficult to combine to the point of allowing these two essential components to always both be at the correct degree of humidity at the end throughout the operating period of these facilities, since the characteristics of the alfalfa and the environmental and climate conditions vary significantly.

Therefore, since the leaves are much more delicate than the stalks, and since they contain almost all the noble elements of the plant, the average humidity of the final product is always a result of the combination of excessively dry leaves and still very humid stalks in order to achieve an average humidity content that allows grinding and pelletizing.

In practice, in conventional dehydration facilities, the leaves are scorched or burned and the stalks still have a high moisture content at the end of the process in order to have acceptable average humidity values. As a consequence of this fact, with conventional dehydration methods the leaves suffer irreparable losses of large percentages of noble products, such as vitamins, carotenes, pigments, and even protein.

SUMMARY OF THE INVENTION

The aim of the present invention is to solve the above described problems by providing a method that allows to dehydrate plants, particularly forage such as alfalfa or the like, obtaining a product that is considerably richer in protein, carotene, vitamins, calcium, and phosphor with respect to the products that can be obtained with the dehydration methods that are currently in use.

Within the scope of this aim, an object of the present invention is to provide a method that allows to obtain a product that is capable of significantly reducing the use of additives or correctives, which are more expensive, in balanced fodder mixtures.

Another object of the present invention is to provide a method that allows to obtain a food product of higher quality with production costs that are comparable to those of currently used products obtained from the dehydration of alfalfa.

Another object of the present invention is to provide a method that allows to obtain various food products that can have, according to the requirements, a substantially full content of leaves, or a substantially full content of stalks, or a metered mixture of these two components.

Another object of the present invention is to provide an easily executable facility for performing the method according to the invention.

This aim, these objects, and others which will become apparent hereinafter are achieved by a method for dehydrating plants, particularly for dehydrating forage, which consists in introducing the forage to be dehydrated in a drier with a retention time and a temperature that are adapted to achieve the at least partial drying of the leaves of the forage, characterized in that the forage that leaves said drier is subjected to a separation operation for separating the leaves from the stalks and in that the leaves and the stalks thus separated are subjected, separately from each other, to additional treatments that include at least one additional drying step for at least one of the two components constituted by the leaves and the stalks.

In order to perform the method according to the present invention, one preferably uses a facility that is characterized in that it comprises a forage dryer in which the outlet port for the at least partially dried forage is connected to means for separating the leaves from the stalks.

BRIEF DESCRIPTION OF THE DRAWINGS

Further characteristics and advantages of the invention will become apparent from the description of a preferred but not exclusive embodiment of the method and of the facility for performing it, according to the invention, illustrated only by way of non-limitative example in the accompanying drawings, wherein.

DESCRIPTION OF THE PREFERRED EMBODIMENTS

Figure 1:
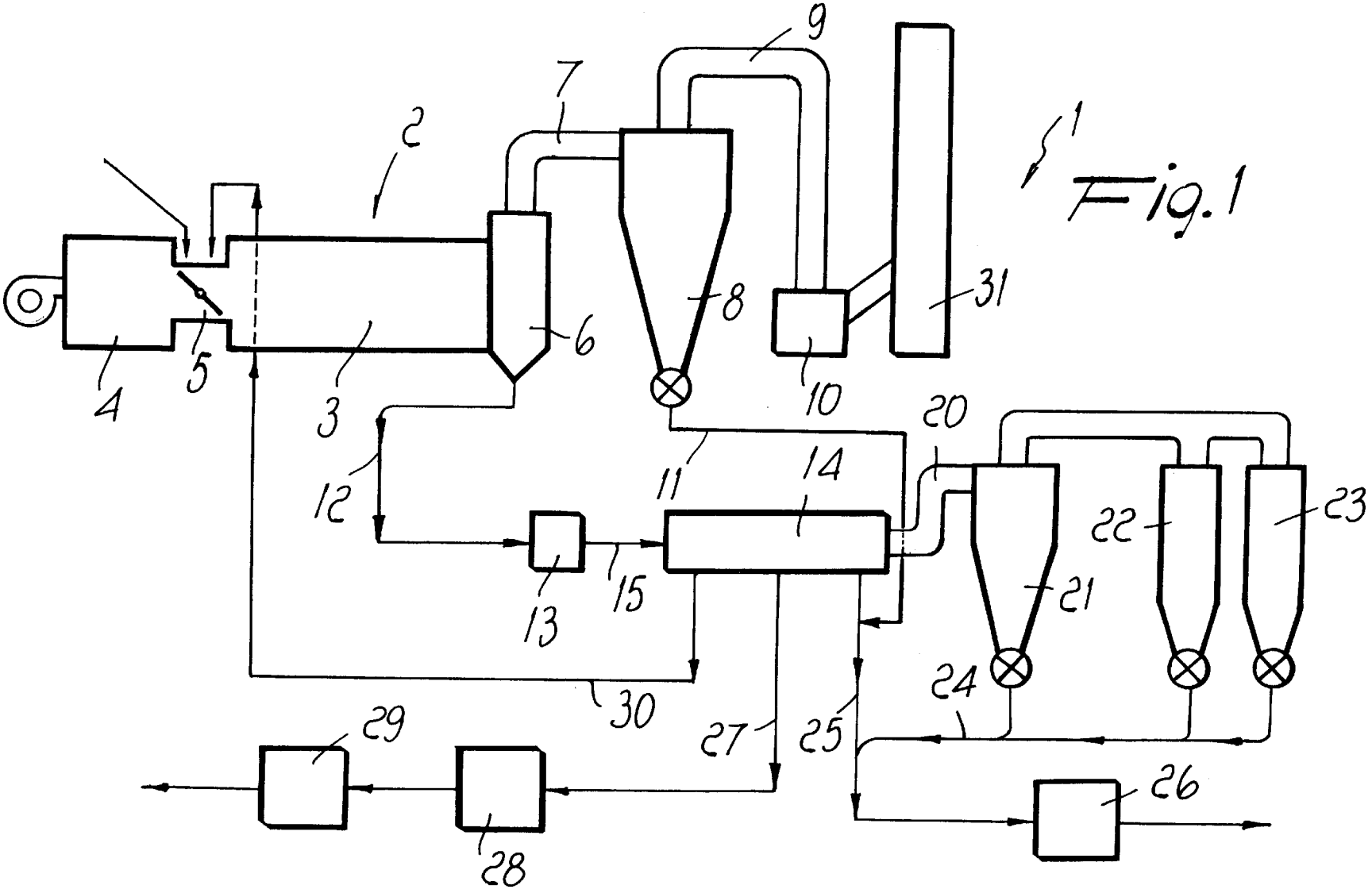
FIG. 1 is a schematic view of the facility for performing the method according to the present invention.
Figure 2:
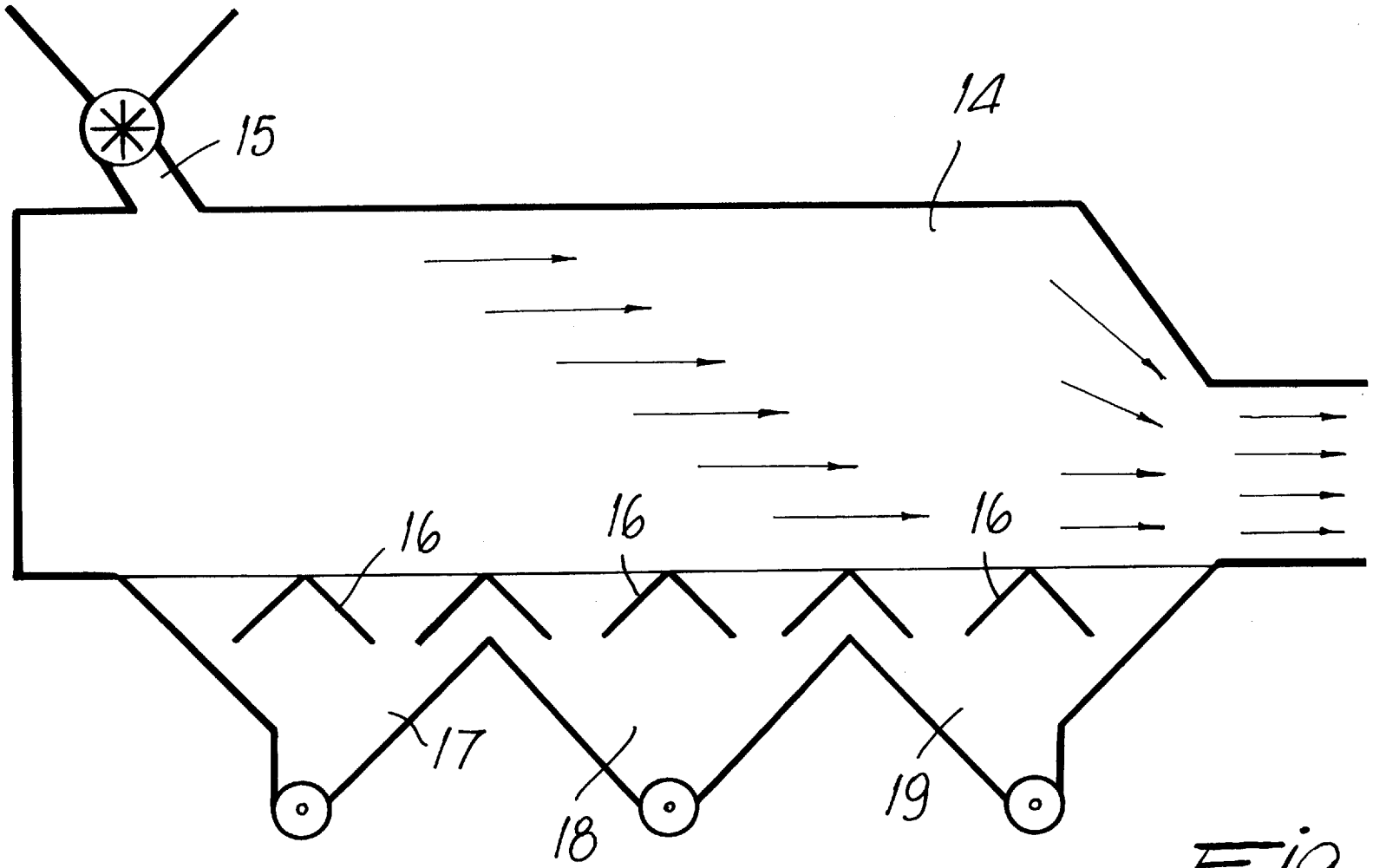
FIG. 2 is a schematic sectional view of a component of the facility according to the present invention.

With reference to the above figures, the facility for performing the method according to the invention, generally designated by the reference numeral 1, comprises a forage drier 2 that can be constituted for example by a conventional high-temperature dryer that is composed substantially of a drum 3 that rotates about its own horizontal axis.

An axial end of the drum 3 is connected to the outlet of a conventional boiler 4, which is used to convey a stream of hot air into the drum 3.

Preferably, the temperature of the air that enters the drum 3 is substantially between 800° C. and 1000° C.

At the same axial end of the drum 3 there is also a port 5 through which the forage to be dried, preferably constituted by alfalfa, is conveyed into the dryer 2.

The drum 3 has, in a per se known manner, on its internal surface, radial paddles that ensure the movement of the forage fed through the port 5, while gradual advancement along the axis of the drum 3 is produced by the stream of hot air that carries the parts of the forage whose weight decreases as a consequence of gradual drying.

The other axial end of the drum 3 is connected to a decantation chamber 6, inside which the at least partially dried forage is collected. The upper end of the decantation chamber 6 is connected, by means of a duct 7, to a conventional cyclone 8, inside which the moisture-rich fumes are separated from the more volatile suspended particles of forage. The outlet of the cyclone 8 is connected to a stack 31 by means of a duct 9, along which a fan 10 is arranged.

The fan 10 ensures the correct flow of hot air from the boiler 4 through the drum 3 and through the decantation chamber 6.

The lower outlet of the cyclone 8, through which the particles of forage separated from the fumes are evacuated, is connected to a duct 25 by means of a duct 11, as explained in detail hereinafter.

The decantation chamber is connected, proximate to its bottom, to a duct 12 through which the less volatile parts of the forage are evacuated.

As an alternative to a rotary-drum drier, said drier may be constituted by a low-temperature belt dryer with temperatures substantially between 90° C. and 200° C. and with naturally longer forage retention times. In this case, too, it is possible to provide,. at the outlet of the drier, a decantation chamber 6 that is connected, in a manner similar to the one described above, to the cyclone 8 and to the duct 12.

The duct 12 is connected to means for separating the leaves from the stalks that comprise a mill 13 and a selection tunnel 14.

The mill 13 can be simply constituted by a conventional mill that separates the leaves from the stalks and partially breaks up said stalks.

The selection tunnel 14 comprises a horizontally arranged chamber inside which a stream of air is made to flow. An upper region of the selection tunnel 14 is connected to the duct 15 that exits from the mill 13, and proximate to the bottom of said chamber there is a plurality of movable baffles 16.

Three hoppers, designated respectively by the reference numerals 17, 18, and 19, are arranged sequentially below the movable baffles 16 along the horizontal extension of the selection tunnel 14.

It should be noted that, instead of the movable baffles 16, it is possible to provide means for varying the speed of the stream of air through the selection tunnel, such as for example variable-speed fans, so as to equally achieve a selection effect.

The hopper 17, which is arranged upstream of the chambers 18 and 19 along the flow followed by the air inside the selection tunnel 14, is meant to receive the heavier parts of the material that arrives from the mill 13, i.e., the more moist stalks.

The hopper 18, which is located between the hopper 17 and the hopper 19, is meant to receive the less moist stalks, i.e., those that have the correct degree of drying, whereas the hopper 19, which is located further downstream than the hoppers 17 and 18 along the advancement direction of the air inside the selection tunnel 14, is meant to receive the lightest parts of the ground material fed into the selection tunnel 14, i.e., the dried leaves.

The outlet of the selection tunnel 14 is connected, by means of the duct 20, to a cyclone 21 whose outlet is furthermore connected to two filters 22 and 23.

The lower end of the cyclone 21 as well as the outlet of the material retained by the filters 22 and 23 are connected to a duct 24 that collects the dust separated from the stream of air that acts as transport fluid inside the selection tunnel 14.

The lower end of the hopper 19 is connected to a duct 25 into which the duct 24 also leads; said duct 25 conveys the dried leaves to a press 26, by means of which the leaves are pelletized.

As an alternative, the duct 25 can be connected to a grinding mill to produce forage-leaf flour, according to the requirements.

The hopper 18 is connected, by means of a duct 27, to another mill 28 that finely shreds the less moist stalks which, once triturated, are also conveyed to a pelletizing press 29.

As an alternative, the duct 27 can be connected to a conventional baling machine, not shown for the sake of simplicity, that packages the less moist stalks in bales.

The hopper 17 is instead connected to a duct 30, through which the more moist stalks are conveyed back to the inlet 5 of the drier 2.

As an alternative, the duct 30 can feed the more moist stalks to a second drier, which is also composed of a rotating drum whose outlet is connected to the duct 27. If a second drier is provided, the selection tunnel can optionally have, at its bottom, only two hoppers for the separate collection of the more moist and less moist leaves and stalks, to be conveyed together to the second dryer.

It is also possible to partially or fully use the hot air that leaves the drier 2 for the operation of the second drier.

It should be noted that advantageously the drying of the leaves can be performed in two steps by feeding the leaves that exit from the drier 2 into another drier, preferably with lower drying temperatures than the drier 2. This method has the advantage of allowing even better drying of the leaves, since by using a drier 2 of the high-temperature type, difficulties are encountered in exactly presetting the optimum retention time of the leaves inside the drier 2. With high drying temperatures, when the leaves have released all their moisture content by evaporation, their temperature in fact rises very quickly due to the fact that the heat that is applied is not dissipated by evaporation, which has by then ended, but exclusively increases the temperature of the leaves, with the danger of partially burning them. Because of this, by drying the leaves in two steps it is possible to perform a first quick drying, removing the leaves from the drier while they still have a certain moisture content, and then complete their drying in the second step at lower temperatures, safely eliminating the possibility of partial burning of the leaves.

The second leaf drying step can be performed, for example, by means of an additional conventional drier arranged along the duct 11 or along the duct 25.

The operation of the facility in the execution of the method according to the invention is as follows.

The forage, after mowing, is fed into the drier 2 through the opening 5. Inside the drier, at a temperature that is substantially between 90° C. and 1000° C., depending on the type of drier that is used and with retention times that can vary according to the requirements, drying of the forage leaves is achieved, with an average residual humidity of preferably approximately 15–20%, whereas the stalks undergo a drying that can vary according to their dimensions, i.e., with more complete drying for smaller stalks and with a less complete drying for larger stalks.

At the outlet of the drier 2, the partially dried forage reaches the decantation chamber 6, from which it is conveyed to the mill 13 through the duct 12.

Any suspended leaf particles carried by the stream of hot air inside the drier 2 are recovered by cycloning by means of the cyclone 8 and are conveyed to the duct 25.

Inside the mill 13, a partial grinding of the forage is performed and has the effect of separating substantially all the dried leaves from the stalks. It should be noted that this partial grinding also has the effect of breaking up the stalks, bringing the residual moisture to the surface and thus facilitating the subsequent drying to which the more moist stalks will be subjected.

The forage thus divided is then conveyed into the selection tunnel 14, where the leaves are actually separated from the more moist stalks and from the less moist stalks.

The more moist stalks are deposited inside the hopper 17, whereas the less moist stalks are deposited in the hopper 18 and the leaves are deposited inside the hopper 19.

The more moist stalks are then conveyed back to the drier 2 or to a second drier, whereas the parts of the forage that are dried correctly are subjected to pelletizing or are ground further to produce flours.

It should be noted that the more moist stalks that are conveyed back into the drier 2 can be mixed with new fresh forage that is fed into the drier 2, so that while the leaves of the green forage are dried the more moist stalks fed back into the drier 2 are also dried further.

In practice, along the duct 25 there is a considerably high percentage of leaves, i.e., of the product that is most valuable because it is the richest in protein, carotene, vitamin, calcium, and phosphor content and can be used as a high-quality integrator for preparing balanced fodder mixtures for animal feeding.

It should be noted that the stalks that are correctly dried by means of one or more drying cycles have an average humidity of approximately 15–20% and can also be used directly, without passing through the mill 28, or can be combined with the dried leaves to obtain an optimized product.

Furthermore, once the correctly dried leaves and stalks have been obtained it is also possible to mix these two components in amounts that can vary according to the use for which the product is meant, so as to obtain a product for animal feeding.

In practice, with the method according to the present invention it is possible to obtain three products for animal feeding: a first product that is constituted by a concentrate of dried forage leaves, whose percentage in said first product is more than 70% by weight relative to the total amount of product; a second product that is constituted by a concentrate of dried forage stalks, whose percentage in said second product is more than 70% by weight relative to the total amount of product; and a third product, which is constituted by a metered mixture of correctly dried stalks and leaves. These products can be in the form of flour, pellets, or not ground, or in any other form according to the requirements.

In practice it has been observed that the method according to the present invention fully achieves the intended aim, since it allows to obtain a primary product, predominantly constituted by dried forage leaves, that contains protein, carotenes, vitamins, calcium, and phosphor, in considerably higher percentages than those that can be obtained with currently used forage dehydration processes.

As a consequence of this fact, it is possible to use said primary product directly to produce fodder without the need to use further additives to enrich the product with protein, carotene, vitamins, calcium, and phosphor, with significant production savings.

Another advantage of the method according to the present invention is that it allows to obtain multiple products with a leaf and stalk content whose ratio can vary according to the requirements and with the desired final degree of humidity.

The method and the facility for performing it, thus conceived, are susceptible of numerous modifications and variations, all of which are within the scope of the inventive concept; furthermore, all the details can be replaced with other technically equivalent elements. Thus, for example, the selection tunnel may also have another structure or may be replaced with other technically equivalent means as regards the purpose of achieving selection of the leaves with respect to the stalks and optionally of the more moist stalks with respect to the less moist stalks.

In practice, the materials employed, as well as the dimensions, may be any according to the requirements and the state of the art.

What is claimed is:

1. A facility for dehydrating plants having mutually attached stalks and leaves, comprising:

a drier for receiving said plants and for drying said plants so as to remove an initial amount of moisture from said plants;

apparatus for separating said plants at least into a first portion of stalks and a second portion of stalks, in which the stalks of said first portion of stalks have a higher moisture content than the stalks of said second portion of stalks; and apparatus for subjecting said first portion of stalks separately from said second portion of stalks to a further drying operation so as to remove a further amount of moisture from said first portion of stalks.

2. A facility according to claim 1, wherein said drier is constituted by a drum drier.

3. A facility according to claim 1, wherein said drier is constituted by a belt drier.

4. A facility according to claim 1, wherein said drier has, at its outlet, a chamber for the decantation of said at least partially dried forage.

5. A facility according to claim 1, wherein said apparatus for separating the stalks from the leaves comprise a grinding mill for separating the leaves from the stalks and a selection tunnel for the separate collection of the stalks with respect to the leaves.

6. A facility according to claim 5, wherein said selection tunnel comprises a horizontally arranged chamber that is fed with a stream of air, hoppers for separately collecting the stalks and the leaves being arranged proximate to the bottom of said chamber.

7. A facility according to claim 6, wherein said chamber of the selection tunnel has a plurality of movable baffles proximate to its bottom and above said collecting hoppers.

8. A facility according to claim 6, further comprising means for varying the speed of the stream of air through said chamber of the selection tunnel.

9. A facility according to claim 6, wherein said chamber of the selection tunnel comprises, proximate to its bottom, three collecting hoppers that are arranged sequentially along the direction of the stream of air inside said chamber of the selection tunnel: a first hopper for collecting the more moist stalks, a second hopper for collecting the less moist stalks, and a third hopper for collecting the dried leaves.

10. A facility according to claim 6, further comprising means for separating and filtering the stream of air that leaves said chamber of the selection tunnel.

11. A facility according to claim 9, wherein the outlet of said hopper for collecting the dried leaves is connected to a pelletizing press.

12. A facility according to claim 9, wherein said second hopper for collecting the less moist stalks is connected, at its outlet, to a mill for grinding the less moist stalks.

13. A facility according to claim 9, wherein said apparatus for subjecting said first portion of stalks separately from said second portion of stalks to a further drying operation so as to remove a further amount of moisture from said first portion of stalks comprises a connection of an outlet of said first hopper for collecting the more moist stalks to an inlet of said drier.

14. A facility for dehydrating plants having mutually attached stalks and leaves, comprising:

a drier means for receiving said plants and for drying said plants so as to remove an initial amount of moisture from said plants;

means for separating said plants at least into a first portion of stalks and a second portion of stalks, in which the stalks of said first portion of stalks have a higher moisture content than the stalks of said second portion of stalks; and means for subjecting said first portion of stalks separately from said second portion of stalks to a further drying operation so as to remove a further amount of moisture from said first portion of stalks.

15. The facility of claim 14 wherein said means for separating said plants is structurally separate from said drier means.

16. The facility of claim 15 wherein said drier means comprises a drying apparatus for internally receiving said plants, and wherein said means for separating said plants are connected externally to said drier means such that said plants are transported out of said drying apparatus to said means for separating said plants.

17. The facility of claim 16 wherein said means for separating said plants are also means for separating said plants into a third portion of leaves, such that the stalks of said first portion of stalks and the stalks of said second portion of stalks are substantially without leaves.

18. The facility of claim 17 wherein said means for subjecting said first portion of stalks separately from said second portion of stalks to a further drying operation so as to remove a further amount of moisture from said first portion of stalks comprise means for feeding said first portion of stalks back into said drier means.

* * * * *